US005380157A

United States Patent [19]

Shaffer

[11] Patent Number: 5,380,157

[45] Date of Patent: Jan. 10, 1995

[54] CERAMIC BLADE ATTACHMENT SYSTEM

[75] Inventor: James E. Shaffer, Maitland, Fla.

[73] Assignee: Solar Turbines Incorporated, San Diego, Calif.

[21] Appl. No.: 159,021

[22] Filed: Nov. 29, 1993

[51] Int. Cl.[6] ..... F01D 5/32

[52] U.S. Cl. ..... 416/220 R; 416/220 A

[58] Field of Search ..... 416/219 R, 219 A, 220 R, 416/220 A, 248

[56] References Cited

U.S. PATENT DOCUMENTS

| | | | |
|---|---|---|---|
| 1,808,888 | 6/1931 | Fahlin | 416/220 A |
| 2,315,574 | 4/1943 | Anderson | 416/220 A |
| 2,350,345 | 6/1944 | Freedman et al. | 416/220 A |
| 2,628,688 | 2/1953 | Diefenderfer | 416/220 A |

*Primary Examiner*—Edward K. Look

*Assistant Examiner*—James A. Larson

*Attorney, Agent, or Firm*—Larry G. Cain

[57] ABSTRACT

A turbine blade having a preestablished rate of thermal expansion is attached to a turbine wheel having a preestablished rate of thermal expansion being greater than the preestablished rate of thermal expansion of the turbine blade. The turbine blade has a root portion having a first groove and a second groove therein. The turbine wheel includes a plurality of openings in which the turbine blade is positioned. Each of the openings has a first groove and a second groove therein. The space or void formed between the first grooves and the second grooves has a plurality of spherical balls positioned therein. The plurality of spherical balls has a preestablished rate of thermal expansion being equal to the preestablished rate of thermal expansion of the turbine blade.

12 Claims, 4 Drawing Sheets

CERAMIC BLADE ATTACHMENT SYSTEM

"The Government of the United States of America has rights in this invention pursuant to Contract No. DE-AC02-92CE40960 awarded by the U.S. Department of Energy"

TECHNICAL FIELD

This invention relates generally to a gas turbine engine and more particularly to a turbine wheel assembly and the joint between a ceramic blade and a turbine wheel.

BACKGROUND ART

In operation of a gas turbine engine, air at atmospheric pressure is initially compressed by a compressor and delivered to a combustion stage. In the combustion stage, heat is added to the air leaving the compressor by adding fuel to the air and burning it. The gas flow resulting from combustion of fuel in the combustion stage then expands through a turbine, delivering up some of its energy to drive the turbine and produce mechanical power.

In order to produce a driving torque, the axial turbine consists of one or more stages, each employing one row of stationary nozzle guide vanes and one row of moving blades mounted on a turbine disc. The nozzle guide vanes are aerodynamically designed to direct incoming gas from the combustion stage onto the turbine blades and thereby transfer kinetic energy to the blades.

The gases typically entering the turbine have an entry temperature from 850 degrees to at least 1200 degrees Fahrenheit. Since the efficiency and work output of the turbine engine are related to the entry temperature of the incoming gases, there is a trend in gas turbine engine technology to increase the gas temperature. A consequence of this is that the materials of which the blades and vanes are made assume ever-increasing importance with a view to resisting the effects of elevated temperature.

Historically, nozzle guide vanes and blades have been made of metals, such as high temperature steels and, more recently, nickel alloys, and it has been found necessary to provide internal cooling passages in order to prevent melting. It has been found that ceramic coatings can enhance the heat resistance of nozzle guide vanes and blades. In specialized applications, nozzle guide vanes and blades are being made entirely of ceramic, thus, imparting resistance to even higher gas entry temperatures.

However, if the nozzle guide vanes and/or blades are made of ceramic, which have a different chemical composition, physical property and coefficient of thermal expansion to that of a metal supporting structure, then undesirable stresses, a portion of which are thermal stresses, will be set up between the nozzle guide vanes and/or blades and their supports when the engine is operating. Such undesirable thermal stresses cannot adequately be contained by cooling.

Furthermore, conventional joints between blades and discs have typically used a fir tree attachment, or root design. Historically a dovetail root design has been used with a ceramic blade in which a metallic compliant layer of material between the highly stressed ceramic blade root and the metallic turbine disc to accommodate the relative movement, sliding friction, that occurs. The sliding friction between the ceramic blade and the metallic disc creates a contact tensile stress on the ceramic that degrades the surface. This degradation in the surface of the ceramic occurs in a tensile stress zone of the blade root, therefore, when a surface flaw is generated in the ceramic of critical size, the blade root will fail catastrophically.

The present invention is directed to overcome one or more of the problems as set forth above.

DISCLOSURE OF THE INVENTION

In one aspect of the invention, a turbine assembly is comprised of a turbine wheel having an outer surface and defining a plurality of generally radially extending openings which intersect the outer surface. Each of the plurality of openings form a generally cylindrical wall having a first groove positioned therein. A plurality of blades are positioned in respective ones of the plurality of openings. Each of the plurality of blades has a root portion confined within a corresponding opening. The root portion has a generally cylindrical surface defined thereon and a first groove is positioned in the cylindrical surface. Each of the first grooves within the plurality of openings is substantially radially aligned with the first groove within the plurality of blades and forms a space therebetween. A plurality of spherical balls are positioned within the space formed between the corresponding first groove within the turbine wheel and the first groove within the blade.

BEST MODE FOR CARRYING OUT THE INVENTION

Figure 1:
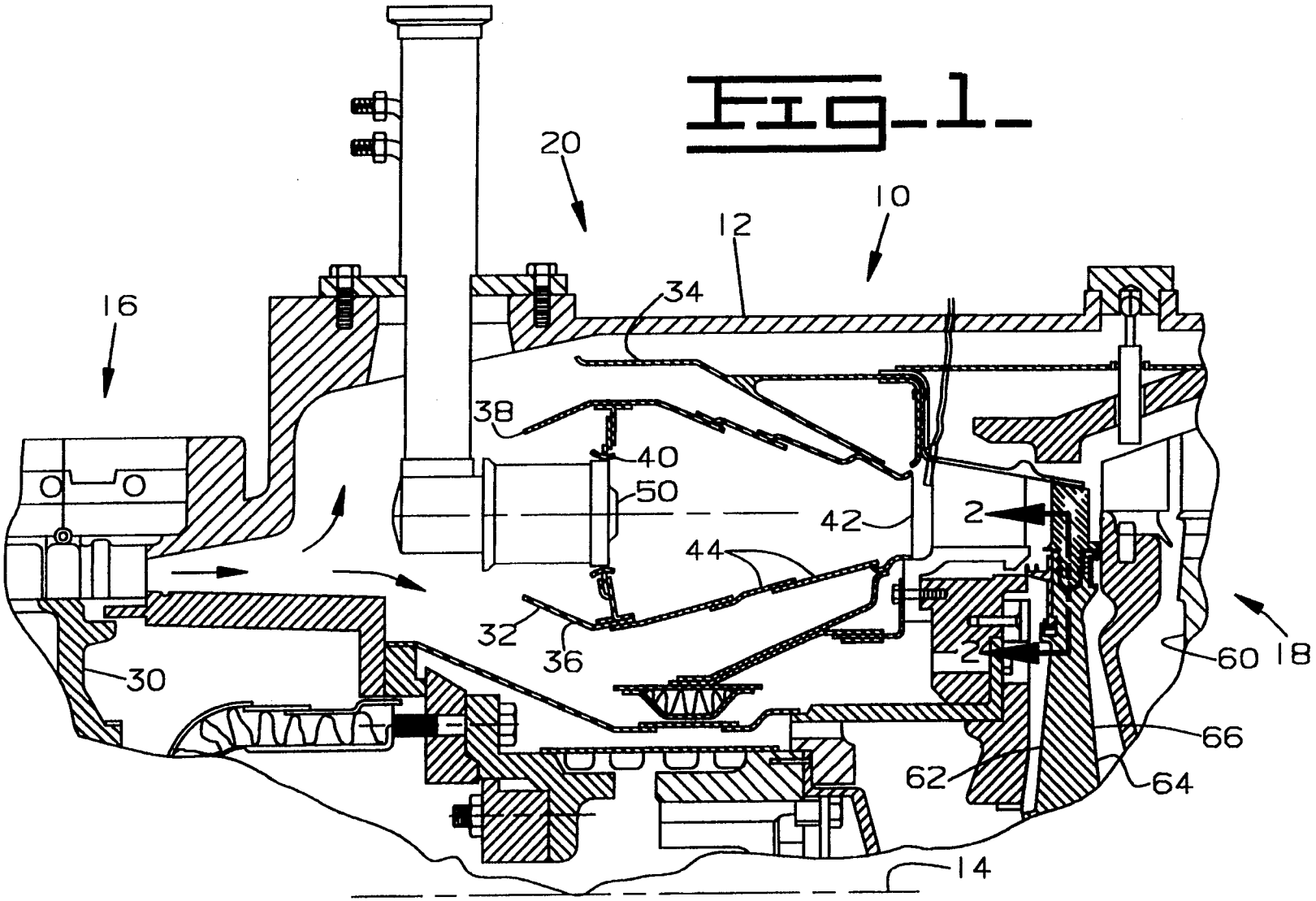
FIG. 1 is a partial side view of a gas turbine engine embodying the present invention with portions shown in section for illustration convenience.
Figure 2:
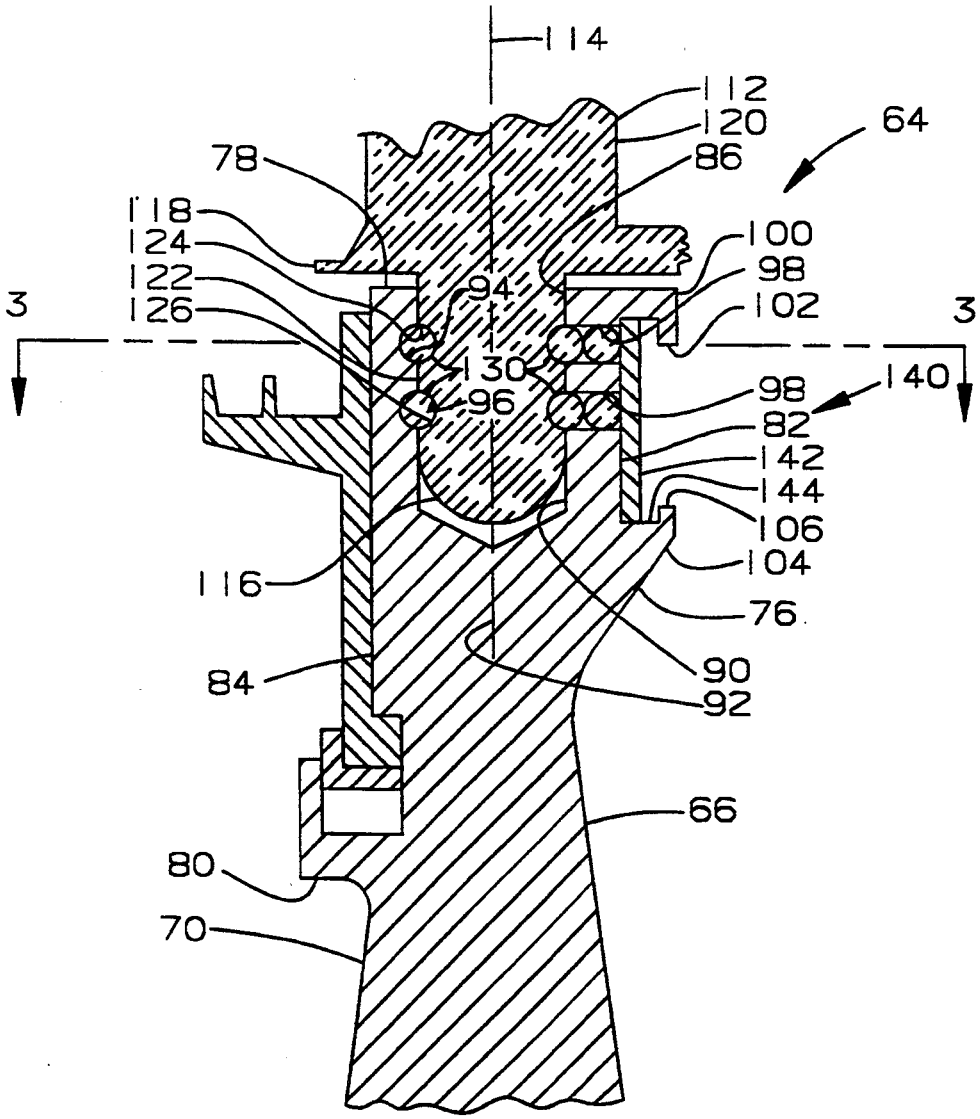
FIG. 2 is an enlarged sectional view of a joint between a ceramic blade and a disc taken along line 2—2 of FIG. 1.
Figure 3:
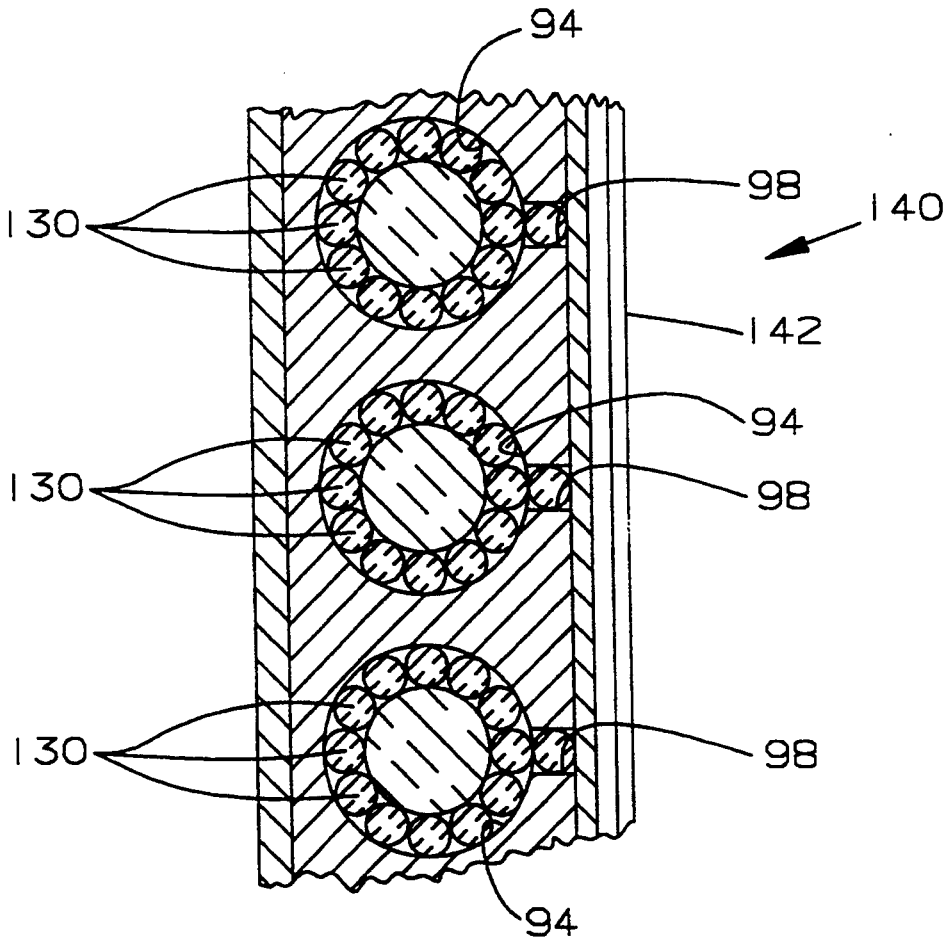
FIG. 3 is an enlarged elevational partially sectional view of the interface of the ceramic blade and the disc embodying the present invention.

Referring to FIG. 1, a gas turbine engine 10 is shown. The gas turbine engine 10 has an outer housing 12 having a central axis 14. Positioned in the housing 12 and centered about the axis 14 is a compressor section 16, a turbine section 18 and a combustor section 20 operatively positioned between the compressor section 16 and the turbine section 18.

When the engine 10 is in operation, the compressor section 16, which in this application includes an axial staged compressor 30 or, as an alternative, a radial compressor or any source for producing compressed air, causes a flow of compressed air at least a part of which communicated to the combustor section 20. The combustor section 20, in this application, includes an annular combustor 32. The combustor 32 has a generally cylindrical outer shell 34 being coaxially positioned about the central axis 14, a generally cylindrical inner shell 36, an inlet end 38 having a plurality of generally evenly spaced openings 40 therein and an outlet end 42. In this application, the combustor 32 is constructed of a plurality of generally conical segments 44. Each of the openings 40 has an injector 50 positioned therein. As an alternative to the annular combustor 32, a plurality of can type combustors could be incorporated without changing the essence of the invention.

The turbine section 18 includes a power turbine 60 having an output shaft, not shown, connected thereto for driving an accessory component such as a generator. Another portion of the turbine section 18 includes a gas producer turbine 62 connected in driving relationship to the compressor section 16. The gas producer turbine 62 includes a turbine assembly 64 being rotationally positioned about the central axis 14. The turbine assembly 64 includes a turbine wheel 66 having a flange 76 defined by a generally rectangular cross-section. The flange 76 has a preestablished rate of thermal expansion, an outer peripheral surface 78, an inner side surface 82 and an outer side surface 84 forming a preestablished width. The flange 76, in this application is made of an alloy steel. Positioned circumferentially in the outer surface 78 of the flange 76 are a plurality of generally evenly spaced openings or bores 86 having a preestablished diameter and depth. Each of the bores 86 define a generally cylindrical wall 90, and an axis 92 radially extending through and centered within each of the bores 86. Positioned within the cylindrical wall 90 of each of the bores 86 is a first annular groove 94 having a predetermined size and depth. In this application, the first annular groove 94 is substantially semi-cylindrical and has a preestablished surface finish therein. As an alternative, the first annular groove 94 could define a generally "V" shaped configuration. The first annular groove 94 is spaced from the outer surface 78 a preestablished distance and extends into the cylindrical wall 90 a preestablished distance. A second annular groove 96 is positioned in the cylindrical wall 90 and is spaced from the outer surface 78 a preestablished distance being greater than the preestablished distance of the first annular groove 94. In this application, the second annular groove 96 is substantially semi-cylindrical and has a preestablished surface finish therein. As an alternative, the second annular groove 94 could define a generally "V" shaped configuration. The second annular groove 96 extends into the cylindrical wall 90 a preestablished distance substantially equal to the distance the first annular groove 94 extends into the cylindrical wall 90. As an alternative, each of the first annular groove 94 and the second annular groove 96 could be of a different size and extend into the cylindrical wall 90 a different depth without changing the gist of the invention. Axially extending from the inner side surface 82 and intersecting each of the bores 86 is a pair of bores 98 intersecting each of the first and second annular grooves 90,92 respectively. An upper flange 100 extends from the inner side surface 82 circumferentially around the flange 76 near the outer surface 78. A tang 102 extends radially inwardly from the upper flange 100. A lower flange 104 extends from the outer side surface 82 circumferentially around the flange 76 radially inwardly of the upper flange 100. A tang 106 extends radially outwardly from the lower flange 104. A gap, not shown, is defined in each of the upper flange 100 and the tang 102 and the lower flange 104 and the tang 106.

Positioned within each of the bores 86 is a blade 112 including a central axis 114 radially extending through and centered in the blade 112. The blade 112 includes a root portion 116 confined within the bore 86, a base portion 118 extending radially from the root portion 116 and a blade portion 120 radially extending from the base portion 118. In this application, the blade 112 is made of a ceramic material, such as a silicon nitride or silicon carbide, and has a preestablished rate of thermal expansion which is less than the preestablished rate of thermal expansion of the flange 76. The root portion 116 has a generally cylindrical configuration defining a cylindrical surface 122 having a preestablished diameter being less than the preestablished diameter of the bores 86. Axially spaced along the cylindrical surface 122 is a first groove 124 being spaced from the base portion 118 a preestablished distance and extending into the cylindrical surface 122 a preestablished distance. A second groove 126 is spaced from the base portion 118 a preestablished distance being greater than the preestablished distance of the first groove 124. The second groove 126 extends into the cylindrical surface 122 a preestablished distance substantially equal to the distance of the first groove 124. The first and second grooves 124,126 within the cylindrical surface 122 are substantially semi-cylindrical. As an alternative, each of the first groove 124 and the second groove 126 could be of a different size and extend into the cylindrical surface 122 a different depth without changing the gist of the invention. Additionally, it is important that each of the blades 112 be anti-rotational. In this application, the base portion 118 prevent rotation between adjacent blades. As an alternative, not shown, other methods could be used, such as a generally elliptical root portion 116 or a flat on the root portion 116 and a set screw.

In the assembled position, the first annular groove 94 and the second annular groove 96 in the flange 76 are substantially radially aligned with the first groove 124 and the second groove 126 in the blade 112 respectively forming a space or void. Interposed in the space between the first annular groove 94 and the first groove 124 is a plurality of spherical balls 130. Interposed in the space between the second annular groove 96 and the second groove 126 is an additional plurality of spherical balls 130. In this application, each of the plurality of balls 130 are made of a ceramic material, such as silicon nitride or silicon carbide, having a preestablished rate of thermal expansion being substantially equal to that of the ceramic blade 112. The spherical balls 130 are of a size sufficient to generally fill the space or void defined between the respective grooves 94,124 and grooves 96,126 between the flange 76 and the blade 112. As an alternative, the preestablished relationship of the spherical balls 130 could be slightly less than the space or void defined by the respective grooves 94,124 and grooves 96,126 between the flange 76 and the blade 112 without changing the essence of the invention.

The plurality of spherical balls 130 are retained within the grooves 94,124 and grooves 92,126 by a retainer means 140 of conventional design. For example, a plate 142 having a generally slit washer type configuration and being of a thin flexible material is positioned in a cavity 144 formed between the outer surface 82, the upper flange 100, the tang 102, the lower flange 104 and the tang 106.

Figure 4:
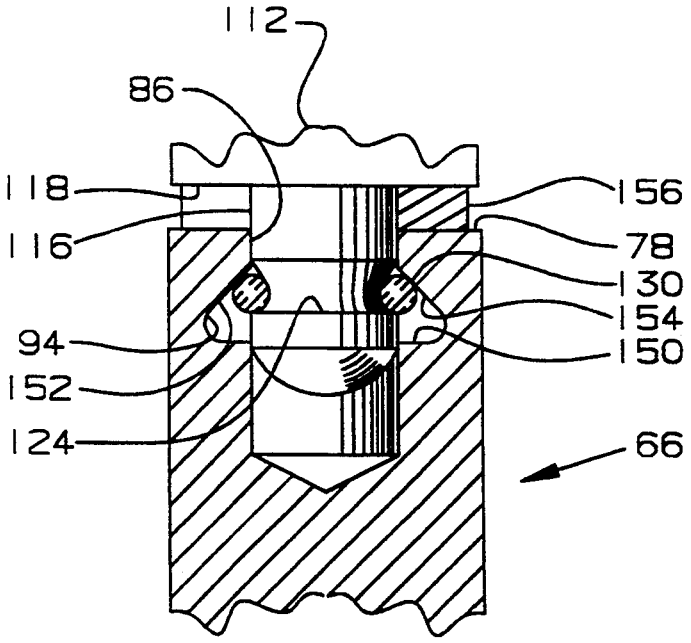
FIG. 4 is an enlarged sectional view of a joint between a ceramic blade and a disc taken along line 4—4 of FIG. 3.

An alternative blade 112 and turbine wheel 66 attachment method is shown in FIG. 4. The turbine wheel 66, as defined above, includes the plurality of bores 86 having the first annular groove 94 therein. In this alternative, the first annular groove 94 has a generally triangular configuration. The triangular configuration includes a bottom portion 150 having an enlarged diameter, a top portion 152 having a reduced diameter in comparison to the bottom portion 150 and a transition portion 154 interconnected therebetween. The root portion 116 of the blade 112, as defined above, includes the first groove 124. Interposed the first groove 124 and the triangular configuration of the first annular groove 94 is the plurality of spherical balls 130. Positioned intermediate the base portion 118 of the blade 112 and the outer peripheral surface 78 of the turbine wheel 66 is a keeper 156 which is retained in position by a conventional means, such as, a set screw, not shown.

INDUSTRIAL APPLICABILITY

In use, the gas turbine engine 10 is started and allowed to warm up and is used in any suitable power application. As the demand for load or power is increased, the engine 10 output is increased by increasing the fuel and subsequent air resulting in the temperature within the engine 10 increasing. The components used to make up the turbine assembly 64, being of different materials and having different rates of thermal expansion, grow at different rates and the forces resulting therefrom and acting thereon must be structurally compensated for to increase life and efficiency of the gas turbine engine 10. For example, as the turbine assembly 64 rotates, centrifugal forces cause the individual blades 112 to exert a force on the flange 76. The surfaces of the first groove 124 and the second groove 126 within the blade 112 transmit the force into the spherical balls 130 within the first groove 124 and the second groove 126. The force is then transmitted to the first annular groove 94 and the second annular groove 96 in the flange 76. The configuration of the grooves 94,96,124,126 and the spherical configuration of the balls 130 permit rolling along the mating surfaces as the blades 112 move within the bores 86. Thus, the centrifugal forces transmitted by the blades 112 are in rolling contact between the flange 76 and the balls 130 and the blade 112 and the balls 130 respectively. The load is reacted through the ceramic blade 112 into the ceramic spherical balls 130 and into the flange 76 and turbine wheel 66. Since the spherical balls 130 and the blade 112 are made of the same material, ceramic, they expand and contract at the same thermal rate. Thus, the contact surface between the balls 130 and the blade 112 is in rolling contact rather than in a scuff mode. The centrifugal forces from the blade 112 attempts to wedge the spherical balls 130 between the blade 112 and the turbine wheel 66 and the balls 130 are placed in a highly compressive load which does not allow a surface induced flaw to propagate and cause catastrophic failure of the ceramic balls 130. As the flange 76, which is made of an alloy steel material, expands and contracts due to a change in temperature and the blade 112 and the balls 130 remain relatively unchanged, the functionality of the rolling contact is continually utilized. For example, the relative geometry of the bore 86 will grow to a greater degree relative to the geometry of the blade 112 and the spherical balls 130 which are made of a ceramic material. Thus, the spherical balls 130 are further positioned in a compressive state and the spherical surface of the spherical balls 130 rotates about the contour of the first and second annular grooves 94,96 as the blade 112 moves. The spherical surface of the spherical balls 130 also rotates about the contour of the first and second grooves 124,126 in the flange 76.

The alternative shown in FIG. 4, is assembled as follows. With the bore 86 pointed in an up position the plurality of spherical balls 130 are loaded into the bottom portion 150 of the first annular groove 94. The root portion 116 of the blade 112 is inserted into the bore 86 until either the bottom of the root portion 116 or the base portion 118 contact the turbine wheel 66. Rotate the turbine wheel 66 with the blade 112 and the plurality of spherical balls 130 positioned therein to have the bore 86 pointed in a down position. With a slow motion, pull the blade 112 away from the turbine wheel 66 and insert the keeper 156 in the space formed between the blade 112 and the turbine wheel 66.

In view of the foregoing, it is readily apparent that the structure of the present invention provides an improved joint between the ceramic blade 112 or a component having a preestablished rate of thermal growth which is low and the turbine wheel 66 or a component having a preestablished rate of thermal growth which is much higher than the ceramic material. The structural arrangement of the spherical balls 130 and the mating surfaces of the grooves 94,96, 124,126 provides a rolling joint which reduces or eliminates surface induced flaws which may cause catastrophic failure of ceramic components.

Other aspects, objects and advantages of this invention can be obtained from a study of the drawings, the disclosure and the appended claims.

I claim:

1. A turbine assembly comprising:

a turbine wheel being made of a material having a preestablished rate of thermal expansion and having an outer surface and defining a plurality of generally radially extending openings which intersect the outer surface, each of said plurality of openings forming a generally cylindrical wall having a first groove positioned therein;

a plurality of blades being positioned in respective ones of the plurality of openings, each of said plurality of blades being made of a material having a preestablished rate of thermal expansion which is less than the preestablished rate of thermal expansion of the turbine wheel and having a root portion confined within a corresponding opening, said root portion having a generally cylindrical surface defined thereon and having a first groove therein;

each of said first grooves within the plurality of openings being substantially radially aligned with the first groove within the plurality of blades forming a space therebetween;

a plurality of balls positioned within the space formed between the corresponding first groove within the turbine wheel and the first groove within the blade.

2. The turbine assembly of claim 1 wherein each of said plurality of balls is made of a material having a preestablished rate of thermal expansion which is substantially equal to the preestablished rate of thermal expansion of each of the plurality of blades.

3. The turbine assembly (64) of claim 2 wherein said plurality of balls (130) define a preestablished radius and said first groove (94) within the opening (78) has a semi-cylindrical configuration and is defined by a preestablished radius being substantially equal to the preestablished radius of the balls (130).

4. The turbine assembly (64) of claim 2 wherein said plurality of balls (130) define a preestablished radius and said first groove (124) within the root portion (114) has a semi-cylindrical configuration and is defined by a preestablished radius being substantially equal to the preestablished radius of the balls (130).

5. The turbine assembly of claim 1 wherein said opening has a second groove defined therein and said root portion has a second groove defined therein.

6. The turbine assembly of claim 5 wherein said second groove in the opening and said second groove within the root portion are generally aligned.

7. The turbine assembly of claim 6 wherein a plurality of balls are interposed the second groove in the opening and the second groove in the root portion.

8. The turbine assembly of claim 7 wherein said plurality of balls being in rolling relationship with the second groove in the blade.

9. The turbine assembly of claim 1 wherein said plurality of balls have a spherical shape.

10. A turbine assembly comprising:

a turbine wheel being made of a material having a preestablished rate of thermal expansion and having an opening therein, said opening having a first groove defined therein;

a blade being made of a material having a preestablished rate of thermal expansion which is less than the preestablished rate of thermal expansion of the turbine wheel and positioned in the opening, said blade having a root portion confined within the opening, said root portion having a first groove therein;

said first groove within the opening being substantially aligned with the first groove within the blade forming a space therebetween;

a plurality of balls positioned within the space formed between the corresponding first groove within the turbine wheel and the first grove within the blade; and said plurality of balls being in rolling relationship with the first groove in the blade.

11. The turbine assembly of claim 10 wherein each of said plurality of balls is made of a material having a preestablished rate of thermal expansion which is substantially equal to the preestablished rate of thermal expansion of the blade.

12. The turbine assembly of claim 10 wherein said plurality of balls have a spherical shape.

* * * * *